US006439310B1

(12) United States Patent
Scott, III et al.

(10) Patent No.: US 6,439,310 B1
(45) Date of Patent: Aug. 27, 2002

(54) REAL-TIME RESERVOIR FRACTURING PROCESS

(76) Inventors: George L. Scott, III, 100 N. Penn, Roswell, NM (US) 88201; Gary L. Covatch, 220 Canyan Village, Morgantown, WV (US) 26508

( * ) Notice: Subject to any disclaimer, the term of this patent is extended or adjusted under 35 U.S.C. 154(b) by 0 days.

(21) Appl. No.: 09/844,951

(22) Filed: Apr. 27, 2001

Related U.S. Application Data

(60) Provisional application No. 60/232,717, filed on Sep. 15, 2000.

(51) Int. Cl.[7] ..... E21B 43/26
(52) U.S. Cl. ..... 166/308; 166/250.1; 166/250.12
(58) Field of Search ..... 166/308, 250.1, 166/250.12

(56) References Cited

U.S. PATENT DOCUMENTS 2,869,642 A * 1/1959 McKay et al. ..... 166/250.01
2,947,869 A * 8/1960 Egan et al. ..... 376/167
3,602,308 A * 8/1971 Vincent ..... 166/281
4,228,885 A * 10/1980 Cavalleri ..... 194/242
4,627,495 A * 12/1986 Harris et al. ..... 166/280
5,069,283 A 12/1991 Mack
5,595,245 A 1/1997 Scott, III
5,635,712 A 6/1997 Scott, III et al.

* cited by examiner

*Primary Examiner*—Hoang Dang
(74) *Attorney, Agent, or Firm*—Loren G. Helmreich; Browning Bushman

(57) ABSTRACT

Methods are disclosed for hydraulic fracturing of subterranean reservoir formations using various combinations of gelled fluid, nitrogen, and carbon dioxide base components, in association with proppant and other additives. Selected base components are pumped down a wellbore tubing while other selected base components are simultaneously pumped down the wellbore tubing-casing annulus for downhole mixing into a composite fracturing fluid in the downhole region of the wellbore proximal to the reservoir objective. Thereby, changes may be timely effected in the composite fluid composition and fluid properties, substantially immediately prior to the composite fluid entering the formation. Such real-time modifications may be effected to readily preempt screenout occurrences and may facilitate composite fluid compositions which otherwise are frequently undesirable to pump from the surface. Such composite fluid combinations include components phases of each of carbon dioxide, nitrogen and a base fluid. Proppant concentrations within the composite fluid entering the formation may be effected in real time without the wellbore-volume lag-time inherent in prior art methods.

23 Claims, 2 Drawing Sheets

REAL-TIME RESERVOIR FRACTURING PROCESS

This application claims priority from U.S. provisional application 60/232,717 filed Sep. 15, 2000.

The invention described herein in part was made in the performance of work supported by the U.S. Department of Energy. Thereby, the U.S. Government has certain rights in the invention.

ORIGIN OF THE INVENTION

1. Field of the invention

This invention relates to hydraulic fracturing in petroleum and natural gas reservoirs, and more particularly to real-time modification thereof by downhole mixing of fracturing components.

2. Background of the Invention

A typical reservoir stimulation process involves hydraulic fracturing of the reservoir formation and proppant placement therein. The fracturing fluid and proppant are typically mixed in pressurized containers at the surface of the well site location. This surface-mixed composite fracturing fluid is generally comprised of an aqueous fracturing fluid, proppant, various chemical additives, including gel polymers, and often energizing components such as carbon dioxide (CO2) and nitrogen (N2). After adequate surface mixing, the composite fracturing fluid is pumped via high-pressure lines through the wellhead and down the wellbore, whereupon ideally the fluid passes into the reservoir formation and induces fractures. Successful reservoir stimulation fracturing procedures typically increase petroleum fluid and gas movement from the fractured reservoir rock into the wellbore, thereby enhancing ultimate recovery.

Reservoir stimulation procedures are capital intensive. Implementation difficulties arise with many known stimulation methods due to various problems, including limitations associated with surface mixing of the stimulation fluid. Typically, a viscous, surface-mixed composite stimulation fluid is injected at pressures adequate to create and propagate fractures in the reservoir. The pressures required to pump such stimulation treatments are relatively high, particularly during injection of the gelled, thickened fluids that may be used to propel proppant into the fractures. These pumping pressures often will increase during the treatment process to an excessive limit, whereupon the operator promptly and prematurely terminates the treatment. Otherwise, serious problems may result, including rupture of surface equipment or wellbore casing and tubulars.

Excessive treating pressures may also occur abruptly during the stimulation fracturing process as a result of premature screenout. Such screenouts are a common problem known in industry that may occur during a fracturing treatment when the rate of stimulation fluid leakoff into the reservoir formation exceeds the rate in which fluid is pumped down the wellbore, thus causing the proppant to compact within the fracture, and into the wellbore. This problem of premature screenout is discussed in U.S. Pat. No. 5,595,245, which is hereby incorporated by reference.

When premature screenout is observed during a fracturing treatment, the operator may elect to reduce the proppant quantity, density, or concentration of proppant per volume of fluid, in order to prevent the occurrence of the screenout. However, when the reduction in proppant concentration is made at the surface, a significant amount of time typically passes before the pumped fluid with altered proppant concentration actually reaches the formation.

A potential problem associated with surface-blended composite fluids is that inhibitors are required to prevent viscous gelling of the stimulation fluid prior to pumping downhole. Highly viscous gels are typically desirable for effective transport of proppant, however, if viscous gelling occurs too early, such as in the tanks and flowlines, or before the fluid is pumped down the well, the efficiency of the overall stimulation job may be compromised due to higher pressures and lower pump rates. To avoid premature gelling, various known chemical inhibitors that include encapsulated or chemically coated inhibitors may be mixed into the composite fluid mixture at the surface to provide a time delayed gelling of the composite fracturing fluid. In addition, other known additives may be incorporated at the surface in an attempt to predictably control the rate of gelling, such as inhibitors to time-delay activation of cross linked polymer gels, which prevents premature gelling of the composite fracturing fluid. A serious shortcoming of this surface-mixed approach, however, is either gelling too early, or too late as evidenced by inadequate gel quality, which frequently results in poor proppant transport and premature screenout.

Typically in many wells the fracturing treatments are terminated prematurely, or reduced in size due to excessive pumping pressures that result from surface mixed and pumped fracturing treatments. In older wells, the premature gelling of the composite fracturing fluid creates a significant potential of exceeding the rated casing or tubing burst pressure. In a 12,000 feet well, for instance, surface wellhead treating pressures often exceed 10,000 psi. whereas bottomhole treating pressures at the reservoir formation depth are significantly higher due to the combination of hydrostatic weight of the composite fracturing fluid (in wellbore) plus surface pumping pressures and friction pressure. The resultant bottomhole treating pressures, if excessive, may crush or fracture proppants in the fracture, which is undesirable due to the release of fines, fracture closure and overall formation damage.

Higher treating pressures are detrimental in terms of requiring lower pump rates, and thereby often alter the overall fracturing stimulation design at the well site. Frequently, the volumetric amount of composite fracturing fluid and proppant that are pumped is lower than desired due to restricted pump rates. Typically higher pumping pressures result in larger horsepower requirements, the usage of more pump engines, and higher cost. Reservoir stimulation fracturing is a capital intensive process, and ineffective reservoir stimulation treatments result in a significant loss of both expended capital and the potential recovery of hydrocarbon reserves.

A typical industry fracturing procedure may commence with mixing of the composite fracturing fluid in storage tanks located on the surface at the well site. The composite fracturing is typically comprised of aqueous gelled fluid, chemical additives and energizers such as N2 and CO2. After mixing, the composite fracturing fluid is pumped via high-pressure lines through the wellhead, down the wellbore and injected into the induced formation fractures. The pumping procedure is typically initiated with the pumping of a pad stage, which is typically fluid without proppant, followed by various stages of fluid containing proppant, and upon termination of the proppant-laden fracturing stage by pumping of the flush stage, which is generally fluid without proppant. This aforementioned sequence occurs when the treatment is pumped as designed, and in the absence of problems including excessive treating pressures and premature screenout.

Another typical industry stimulation technique is known in industry as hydraulic notching or "hydrajetting", whereby fluid is injected downhole to cut slots into the production casing or openhole reservoir formation, and thereby induce fractures in the reservoir formation. Conversely this technique may also be used in openhole and horizontal well stimulation procedures. This known stimulation procedure comprises pumping limited proppant concentration during fracturing through casing or in openhole formation, whereby fluid with proppant is typically pumped via tubing through Tungsten jet nozzles that are located at the distal end of the tubing. In the hydrajetting process, mixing of the tubing and annular flow-streams occurs adjacent to the reservoir formation as generally similar fluids are simultaneously pumped down casing. This procedure is typically limited to stimulation applications involving smaller fractures where proppant concentrations are relatively low (usually less than 5 pounds per gallon) in comparison to most typical sand-fracturing techniques, and furthermore the total amounts of proppant that are placed in the fracture are relatively low.

The hydrajetting process may include pumping of different fluids simultaneously down annulus and tubing, in terms of one fluid type consisting of proppant. This process is flexible in allowing different fluid types including acid to be used, but is also relatively expensive in comparison to typical known fracturing techniques. Annular rates are adjusted to maintain fracturing pressures as fractures are generated by the hydrajet fracturing process. A limitation in the use of this system occurs, however, as jets may become eroded during the fracturing injection process, in addition turbulent flow patterns may disperse proppant in the near-wellbore fractures. The proppant washout may be due to a Bernoulli affect, whereby the annular pressures are lower than the fracture tip pressures.

SUMMARY OF THE INVENTION

In accordance with the present invention, there is provided a real-time hydraulic fracturing process in which substantial quantities of both nitrogen and carbon dioxide may be separately injected, via the tubing string and casing annulus, to form, in the downhole region of the wellbore, a composite fracturing fluid that may include an aqueous-based fluid, a proppant, N2 and CO2 energizers and various other chemical components. This inventive process may be used to stimulate reservoirs in vertical and horizontal wells, and in openhole and cased wells. The inventive system may also be used for enhanced reservoir recovery procedures to remediate depleted reservoirs in mature fields, via short phase tertiary CO2 injection.

Downhole-blending proximal to the reservoir zone is accomplished by dual injection of different fluids through coiled or conventional tubing and casing annulus. A composite fracturing fluid is thus created downhole prior to injection into the reservoir formation fracture. The aqueous based fracturing fluid may be incorporated into either or both of the gases at the surface and may include proppant and other chemical components, which form the composite fracturing fluid upon mixing downhole. This downhole-mixed fracturing fluid is blended downhole to avoid excessive friction pressures and then injected at a desirable thickened viscosity and at a pressure sufficient to implement hydraulic fracturing of the selected reservoir interval.

Known additives, including thickening agents, may be incorporated into the base-fluid to increase fluid viscosity, to improve proppant suspension, leak-off and related rheological properties. Carbon dioxide may be provided in liquid phase via the tubing and nitrogen may be provided in gaseous phase via the casing, or conversely the carbon dioxide may be injected down the casing and nitrogen down the tubing. Thorough mixing of the propping agent with the composite stimulation fluid preferably occurs immediately above or adjacent to the reservoir interval where the induced reservoir fracture or fractures are propagated. The procedure of downhole-mixing may be accomplished concurrent with tracer monitoring, in real-time, as described in our U.S. Pat. No. 5,635,712 (Scott-Smith), which is hereby incorporated by reference.

In the event of a premature screenout, an operator typically immediately ceases pumping proppant down the casing annulus and the fracturing job is terminated prematurely, or conversely the operator might attempt to abruptly increase the rate of pumping in an often futile endeavor to create new fracture growth, or increase the existing fracture width. However, these known techniques typically do not always yield satisfactory results, and may even worsen the problem in terms of screening out, fracturing out of the desired reservoir zone, or ruining the wellbore casing due to excessive pressures and resultant pipe rupture.

A variety of problems are avoided in real-time by this method of downhole mixing, which provides the ability to substantially instantaneously modify stimulation treatment by rapid changes in pump rate, fluid rheology and proppant concentrations. This inventive system typically minimizes friction pressures and thus provides lower treating pressures and higher pumping and injection rates. Downhole mixing facilitates true real-time modification of the fracture treatment, and provides near instantaneous alteration of fluid viscosity and proppant concentrations at the reservoir, as is described further below.

DETAILED DESCRIPTION OF THE PREFERRED EMBODIMENTS

Figure 1:
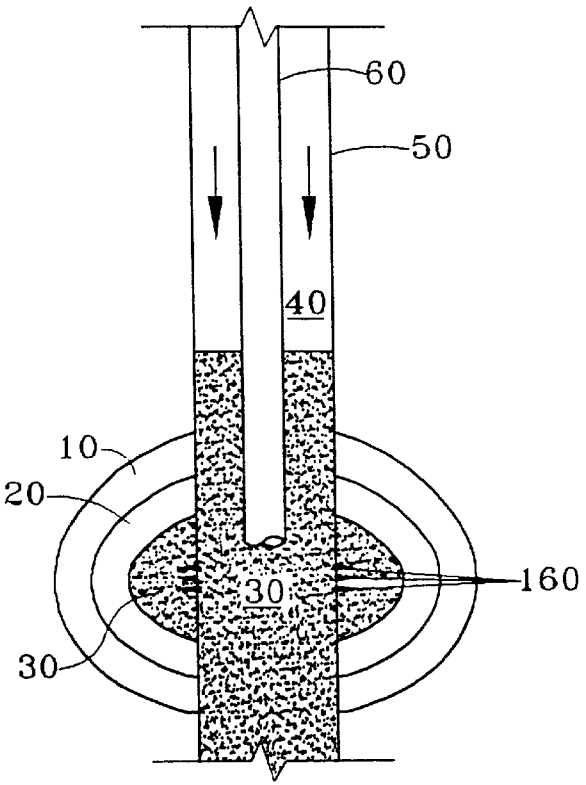
FIG. 1 is a schematic cross-sectional representation of a fracturing procedure showing the various stages involved.

FIG. 1 illustrates various stages during a typical fracturing treatment sequence, whereby fracturing fluid is blended downhole and pumped in pre-pad (10), pad (20), proppant (30) and flush (40) stages. As indicated, aqueous fluid, which might also be comprised of gelled hydrocarbons, is pumped down casing (50) while the tubing 60) is a "dead string", which provides the operator measurement of bottomhole treating pressure during the fracturing process. Alternately, the surface-mixed composite fracturing fluid may be pumped down tubing (60), or the same fluid may be pumped simultaneously down both tubing and casing. The composite fracturing fluid is generally comprised of various additives, including gel, proppant, or energizers including CO2 and Nitrogen, which are mixed at the surface prior to pumping down the well for injection into the formation to induce fracturing.

Figure 2:
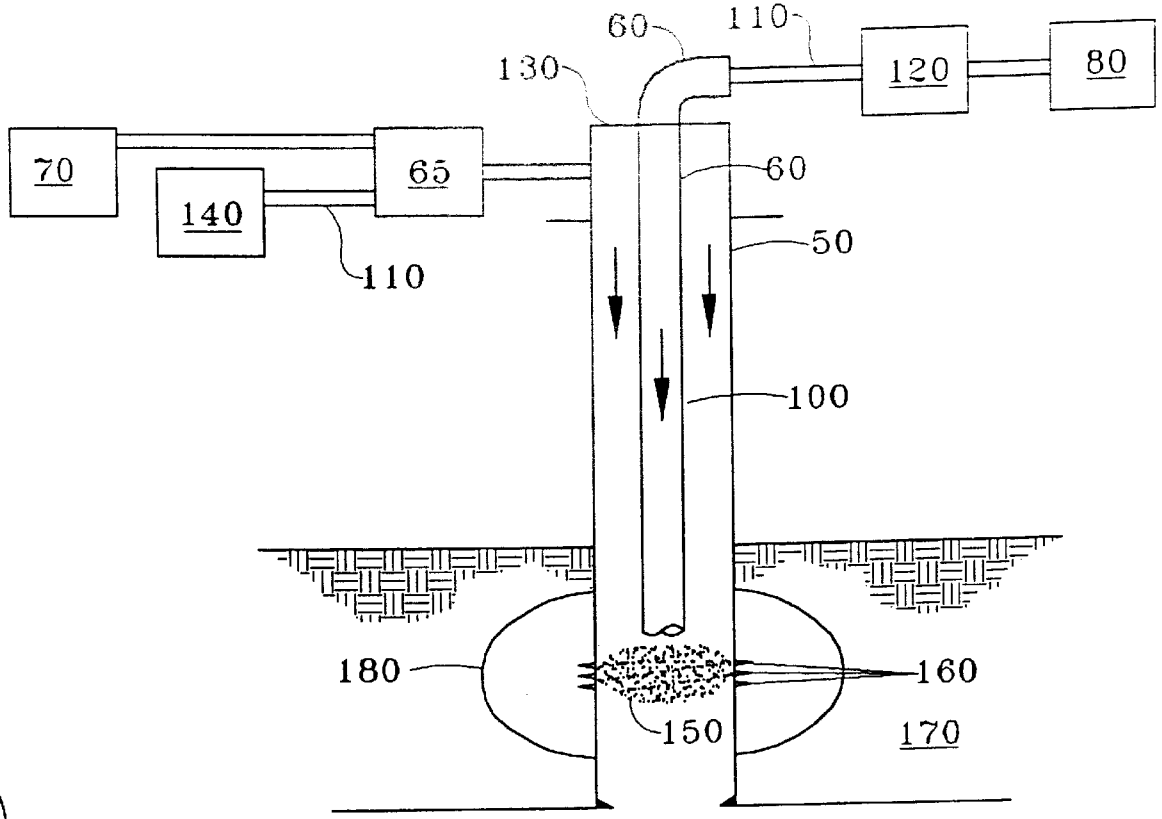
FIG. 2 illustrates a typical downhole-blended real-time hydraulic fracturing operation illustrating surface facilities and pump trucks, with simultaneous injection of different components down tubing and casing to form a composite fracturing fluid in the downhole region.

In the inventive embodiment illustrated in FIG. 2, the novel process of employing carbon dioxide, nitrogen, aqueous fluid and other chemical additives in accordance with downhole mixing may be understood by reference to the hydraulic fracturing operation as indicated. Aqueous gel (65) with Nitrogen (70), and liquid CO2 (80) are pumped concurrently down casing (50) and tubing (60) respectively, at constant or variable ratios during successive treatment stages. The liquid CO2 (80) is pumped from storage tank via high pressure line (110) by pump (120) through the wellhead (130) and down the tubing (60) during simultaneous pumping of gelled fluid (140) with methanol and Nitrogen (70) down the cased wellbore (50). Downhole-mixing forms a composite fracturing fluid (150) above or adjacent to perforations (160), which are located proximal to the desired reservoir (170) objective. A hydraulically induced fracture (180), shown in cross-sectional view, contains the composite fracturing fluid (150). Alternate arrangements of surface equipment, for mixing various components at the surface, are possible. The fluid content of the composite fracturing fluid is typically subject to water leakoff into reservoir formation (170). Different combinations of known fluid components and chemical additives may be mixed downhole to reduce the fluid leakoff.

Figure 5:
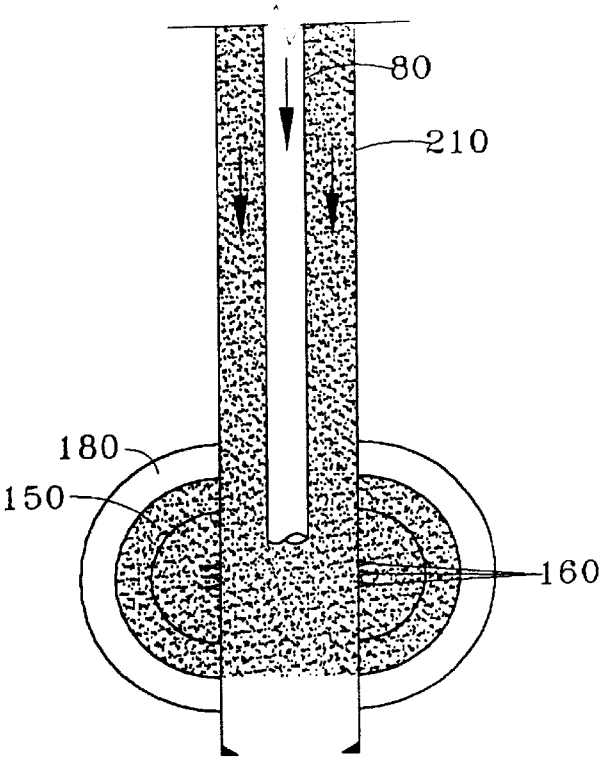
FIGS. 3–5 illustrate variations and/or consecutive progression of downhole-mixed well stimulation procedures with pumping of various components down tubing and casing annulus.
Figure 4:
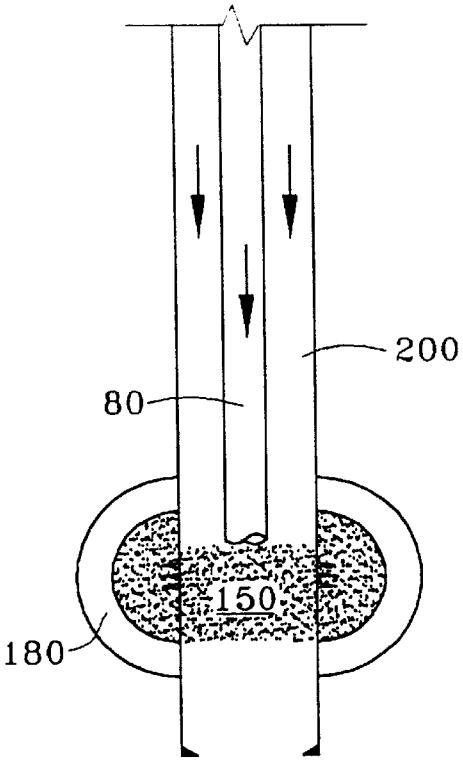
Figure 3:
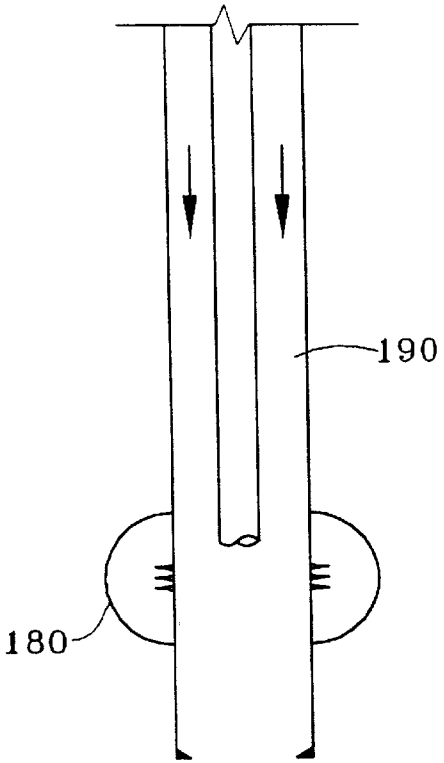

FIGS. 3–5 show a downhole-mixed fracturing procedure sequentially as the treatment progresses through various stages. FIG. 3 shows the initial fracturing fluid (190) pumped via casing into the reservoir zone of the well adjacent to the reservoir formation to be fractured. Fracture initiation is established (as evidenced by formation breakdown pressure) whereupon the formation mechanically fails and one or more fractures (180) are formed during injection of this initial pad stage (190) into the reservoir formation. The initiation of a fracture or fractures in the formation usually is accompanied by a relatively abrupt and substantial decrease in bottomhole treating pressure, which is monitored by operator at the well site surface.

FIG. 4 shows the subsequent mixing downhole of composite fracturing fluid (150), as fluid component (200) is pumped via casing and CO2 (80) is concurrently pumped down tubing. In this embodiment, the pump rates may be varied for the purpose of achieving desirable fracture growth and proppant placement within the reservoir zone. In addition, fluid rheology may be selectively altered, in real-time, as a result of modification of relative pump rates at surface of tubing versus casing. Both the composite fracturing fluid rheology and proppant concentration may be modified essentially at or near the perforations, in real-time. This system facilitates prompt changes in proppant concentration, which is particularly important under certain circumstances such as when attempting to avoid premature screenout of the fracturing treatment. Avoidance of premature screenout may be achieved by prompt reduction of proppant concentration in the downhole region by increasing the rate of clean (i.e. without proppant) fluid or energizer (CO2, Nitrogen) relative to the proppant-laden aqueous fluid. Avoidance of screenout in real-time thus may be achieved by increasing the relative rate of clean fluid, or energizer, from tubing, with respect to sand-laden fluid that is pumped via casing. Both tubing and casing flowstreams may separately or together include chemical additives that are specifically applied to further minimize the rate of fluid leakoff into the formation, which contributes toward the occurrence of premature screenout.

FIG. 5 illustrates the pumping of a proppant-laden slurry (210) including energizers (such as N2) down casing concurrent with the pumping of CO2 (80) down tubing. Real-time modification of the composite fracturing fluid (150) and to another composite fracturing fluid (160), including varied proppant concentration, may be facilitated by adjusting the injection rates of tubing and casing relative to each other. The net composition of the composite fracturing fluid (i.e. rheologic properties) and proppant concentrations may be altered as desired by altering the rates that the tubing and casing components are pumped. For example, the composite fracturing fluid may be adjusted, in real-time, from a ratio of 40% CO2–30% N2–30% aqueous fluid slurry (with proppant) to a 80% CO2–15% N2–15% aqueous fluid slurry by increasing the volumetric rate of CO2 pumped down tubing. Although the pumping equipment is located at the surface, like a syringe the effectuated increase in tubing pump rate is immediately evidenced at the bottom of the wellbore and results in a real-time change in the composite fracturing fluid entering the formation. As a result, the proppant concentration is changed in real-time by the increased ration of clean fluid or CO2 relative to the proppant-laden slurry. The rate of change may be further accentuated by simultaneously decreasing the casing annular pump rate while increasing the tubing pump rate, such as might be indicated by premature screenout and the need to radically reduce proppant entry into the formation.

According to the present invention, each of at least two fluids used for fracturing formations penetrated by subterranean wellbores may be pumped down respective tubular conduits, simultaneously, to mix and interact in a downhole portion of the wellbore forming a composite fracturing fluid therein, which is then pumped into the formation/reservoir.

The pump rate of fluid in one or both tubular conduits may be selectively and individually varied to effect changes in composition of the composite fluid, substantially in real time to exert improved control over the fracturing process, including the quality, physical and chemical properties of the composite fluid entering the formation. Proppant transport qualities thereby may also be modified substantially in real time. Other benefits may also be realized, such as reduced friction losses, reduced hydraulic horsepower requirements, and improved pump rate limits over the restrictions that may be imposed by wellbore tubular sizes.

By providing separate conduits for respective separate fluid compositions at the surface, composite downhole fracturing fluid combinations that might otherwise have been impractical if mixed at the surface, may be permissible. For example, a first fracturing fluid phase including carbon dioxide may be pumped down the tubing, while a second fluid phase including nitrogen, gelled aqueous fluid and proppant may be pumped down the casing annulus. The first and second fluid phases may combine and mix downhole in the casing to form a composite fracturing fluid that might otherwise have exhibited too much friction loss to have been pumped from the surface as a composite fracturing fluid. In like fashion, cross-linking may be performed downhole in the casing without relying on "delayed" cross-linking techniques that result from predictable fluid pH changes. For example, a borate gel may be incorporated concurrently with CO2, which if mixed at the surface the CO2would act as an efficient breaker of the borate gel crosslinking action.

Often, a desirable embodiment may of downhole-mixing may be used to create viscous inter-fingering of CO2or other gaseous phases within the aqueous pad fluid that is present in the formation fracture. Although mixing along the interfaces of the different density phases may also occur, the vertical separation of discrete phases in the fractures, due to fluid phase or density variations, may likely result. Under some circumstances this discrete separation of different phase types in the fracture is desirable, such as to avoid placement of proppant in water-productive zones, or to avoid fracturing into gas-oil, gas-water, or water-oil contacts in the reservoir.

The term "aqueous fracturing fluid" as used herein may be defined broadly to encompass any liquid fracturing fluid, including water based fluids, alcohol based fluids, or crude oil based fluids, or any combination thereof. Energizers such as carbon dioxide and/or nitrogen may be pumped down one or both tubular conduits, individually or in combination with one of the aqueous fracturing fluids or some portion thereof. "Carbon dioxide" may include liquid carbon dioxide, and may also include carbon dioxide miscibly dissolved in a liquid, or foamed with another liquid as either the continuous or discontinuous phase. "Nitrogen" may include also include nitrogen or a nitrogen containing compound alone, or mixed with, foamed, or partially dissolved in a liquid, or without a liquid. Carbon dioxide in the liquid phase is highly soluble in water, however, nitrogen is relatively insoluble in water, even at comparatively high pressures commonly encountered at the bottom of a well.

Water based fracturing fluids may include fresh water based fluids, sea water based fluids, or brine solutions, and may further include added salt compounds, such as KCl and NaCl. Alcohol based fracturing fluids may include aliphatic alcohols such as methanol, ethanol, isopropyl alcohol, tertiary butyl alcohol and/or other alcohol based compounds. Oil based fracturing fluids may also be included within the term "aqueous fracturing fluid" as used herein, and may include "live oil," "dead oil," "crude oil," "refined oil," condensate, or other hydrocarbon based fluids. Any combination of gelling, thickening, cross-linking, or other known fracturing fluid additives may be included in any of the above fracturing fluids.

Another embodiment comprises pumping aqueous fluid with proppant and other chemicals additives, including methanol or other alcohols, down casing while concurrently pumping CO2 down tubing. Or conversely CO2 may be mixed with Nitrogen, or 100% Nitrogen may be pumped down tubing for admixture with fluid components. As a result of pumping this configured embodiment, the composite fracturing fluid that is comprised of aqueous fluid, methanol, proppant and CO2, is pumped at substantially reduced pumping pressures relative to the current industry practice of first mixing said components in surface tanks prior to pumping down the wellbore. The advantages of this downhole-blended embodiment include lower treating pressures, lower horsepower pumping requirements, and lower overall costs related to the procedure. In addition, this procedure provides means for adjusting both fluid rheology and proppant concentration in real-time. Said adjustments in rheology include changes in gel strength, viscosity, and gel-breaker quality.

In another inventive embodiment, downhole-mixing may be achieved by the pumping of aqueous gel crosslinking agents down tubing or casing, while concurrently pumping gel crosslinking activators and other chemical additives down casing or tubing, respectively, to result in a more precisely controlled crosslinking of the composite gelled fracturing fluid. Cross-linking agents may be blended in the downhole region with polymeric thickening agents comprising borate gels or multivalent metal ions such as titanium, zirconium, chromium, antinomy, iron, and aluminum. The cross-linking agents and polymer combinations include, but are not limited to mixing guar and its derivatives as a polymer with a cross-linking agent of titanium, zirconium or borate; a polymer composition of cellulose and its derivatives cross-linked with titanium or zirconium; acrylamide methyl propane sulfonic acid copolymer cross-linked with zirconium.

Downhole mixing provides efficient turbulent dispersion of both carbon dioxide and nitrogen in the gelled aqueous fluid. This downhole-blending procedure may also be conducted with either or both Nitrogen and CO2 added into the downhole-mixed composite fracturing fluid, in various stages or the entirety of the fracturing treatment. Or conversely, Nitrogen and CO2 energizers may not be required in some circumstances, such as when adequate reservoir pressures are present to assure a relatively prompt flowback and cleanup of the composite fracturing fluid. $C0_2$ may be supplied as a liquid at about −10° F. to 10° F. and at a pressure of about 250 to 350 psig. Nitrogen may be supplied as a gas, normally at ambient temperature of from about 65° F. to 115° F. The composite fracturing fluid may be at a pressure at the wellhead that is typically within the range of from less than 1,000 to more than 12,000 psig.

In addition, various chemical additives may be mixed downhole to modify gel quality. Downhole-mixed hydrophyllic gels may be be employed, which swell when water molecules are encountered. As a result, gels may be primed by downhole-mixing with activators and known chemicals to create freshly reactive hydrophilic gels that drastically increase fluid viscosity whenever water-productive zones are encountered, thus plugging or sealing fractures as a result. Thus, as fracture propagation out of a desired reservoir interval occurs, hydrophilic molecules may be created in the downhole region for binding water molecules and concurrently sealing the fracture to minimize unwanted water production.

Enhanced gels may be created by downhole blending. Chemical mixtures that are created or activated by downhole-mixing may be employed to modify relative fluid or gas flow characteristics of the reservoir rock. Relative reservoir permeability may be modified by application of known chemicals and known activators that are mixed in the downhole region, particularly those that react relatively rapidly, as compared to current practices of pumping surface-admixed gels that often may be compositionally unstable. CO2and nitrogen may be included in this process. CO2, nitrogen and various other known additives including surfactants may be mixed downhole to alter wetting properties and interfacial tension angles between the hydrocarbon and reservoir rock. The gel rheology and ratios of nitrogen and carbon dioxide to the aqueous fracturing fluid may be altered at various stages of operation, in real-time, if a sudden unanticipated change in bottomhole treating pressure occurs, or as early premature screenout is evidenced or suspected.

During the fracturing process, a typical propping agent, such as Ottawa frac sand or ceramic particles, may be employed in concentrations ranging from less than 0.5 to 15 pounds of sand per gallon of fracturing fluid. Viscosifying agents may be employed to increase the viscosity of the aqueous solution and to increase the propping agent concentration, which may be progressively increased, or decreased as desired during the fracturing treatment.

Subsequent to the injection of the propping agent into the fracture, it may be desirable to complete the operation with the injection of a wellbore flushing fluid that is absent propping agent. This flushing fluid functions to displace previously injected propping agent into the fracture and reduces the accumulation of undesirable quantities of propping agent within the well proper. The flush stage may also include various chemical additives including resin activators and inhibitors.

At the conclusion of the displacement of proppant-containing fluid, the fracturing operation normally is concluded by the injection of a flushing fluid to displace the propping agent into the fracture. The well may then be shut in for a period of time to allow the injected fluid to reach or approach a state of equilibrium, with both the carbon dioxide and the nitrogen in the gaseous phase. After the well is placed on production by flowing the well back, via a positive pressure gradient extending from the reservoir to the surface via the wellbore, the co-mingled nitrogen and carbon dioxide function to effectively displace the aqueous fracturing fluid from the formation. This provides a clean-up process at the conclusion of the fracturing operation since both nitrogen and carbon dioxide dispel fluids from the formation.

By using the inventive process of downhole mixing, the operator has more options when faced with premature screenout. These options include simultaneously increasing pump rate down the tubing with circulation of the casing fluid into pits, or conversely, the operator may elect to dilute proppant concentration entering the reservoir in real-time by increasing the pump rate of clean fluid relative to the pump rate of proppant-containing slurry, thus decreasing the amount of proppant per volume of composite fracturing fluid entering the formation. This inventive downhole mixing method may also be used to avoid screenout by increasing the effective admixture of additives for the purpose of minimizing fluid loss to the formation, in real-time.

As apractical matter, the addition of polymeric thickening agents, and other additives incorporated therewith, hydration of the aqueous fluid to form the initial gel, and the addition of propping agent may be accomplished under ambient surface temperature and pressure conditions. Injection of these components via tubing and casing is accomplished to induce downhole-mixing adjacent to the reservoir.

A cross-linking agent may be injected separately (down tubing) from the other chemical components (down casing), so that initiation of cross-linking reaction occurs downhole immediately prior to injection of the composite fluid into the reservoir. This facilitates avoidance of a premature increase in viscosity of the fracturing fluid as it travels downhole in the casing or tubing, which often occurs with surface-mixed composite fluids. Premature viscosification of the fracturing fluid creates excessive treating pressures as a result of friction loss. During a fracturing procedure, increased fluid friction requires increasing hydraulic horsepower, which increases costs and often restricts overall pump injection rates.

The composition of the aqueous phase of the fracturing fluid may include polymer gelling agents, surfactants, clay stabilizers, foaming agents, and potassium salt. Methanol may be added to the fracturing fluid in those cases where the formation contains substantial quantities of clay minerals. It is often times desirable to add from about 10–20 volume percent methanol to the fracturing fluid in such circumstances. Polymeric thickening agents are useful in the formation of a stable fracturing fluid. Examples of known thickening gelling agents may contain one or more of the following functional groups: hydroxyl, carboxyl, sulfate, sulfonate, amino or amide. Polysaccharides and polysaccharide derivatives may be used, including guar gum, derivatized guar, cellulose and its derivatives, xanthan gum and starch. In addition, the gelling agents may also be synthetic polymers, copolymers and terpolymers. Cross-linking agents may be combined with the solution of polymeric thickening agents including multivalent metal ions such as titanium, zirconium, chromium, antinomy, iron, and aluminum. The cross-linking agents and polymers may be combined as desired via downhole mixing. These combinations include but are not limited to (1) admixing guar and its derivatives as a polymer with a cross-linking agent of titanium, zirconium or borate; (2) polymer composition of cellulose and its derivatives cross-linked with titanium or zirconium; (3) acrylamide methyl propane sulfonic acid copolymer cross-linked with zirconium. The amount of thickening agent utilized depends upon the desired viscosity of the aqueous phase and the amount of aqueous phase mixed downhole in relation to the energized phase, that is, the liquid carbon dioxide and nitrogen phase. As the amount of liquid carbon dioxide and nitrogen increases, the amount of aqueous phase will commonly be 20% to 50%. Reservoir injection rates and composition of the component fracturing fluid will vary in the downhole region as a function of modification of relative pump rates for tubing and casing. This allows the operator to control proppant concentration and relative gas-fluid ratios as the composite fluid enters the reservoir fracture, all of which may be varied or kept constant, in real-time as desired by the operator.

Additives and water are typically admixed into an aqueous fracturing fluid at the surface throughout the fracturing operation, or the gelled fluid may be formulated before the operation and kept in surface storage tanks until needed. Various additives as described may then be blended into the water in the tanks, or via downhole blending, depending on the operator's objective intent. After additives are thoroughly blended with the water, the water becomes "gelled", whereby the thickened aqueous fluid may be transferred from the storage tanks to a blender. Proppant, when required, may be added via mixing tub attached to the blender at a selected rate to achieve the required concentration, in pounds per gallon of liquid, to obtain the desired downhole concentration. The treating fluid or gel-proppant slurry may be transferred by transfer pumps at a low pressure, usually about 100–300 psi, to high pressure generally greater than 500 psi, by tri-plex pumps. The tri-plex pumps inject the separate fracturing components into the treating lines that are connected directly at the wellhead to tubing and casing, at a desired rate and pressure adequate to hydraulically fracture the formation.

Carbon dioxide may preferably be introduced in the liquid phase down the bore of the tubing string, whereas typically nitrogen is pumped in the gaseous phase down the casing (annular area between the tubing string and the casing). The agitation and turbulent shearing associated with downhole blending provides adequate mixing of the carbon dioxide and nitrogen within the aqueous fluid mixture. Downhole mixing according to this invention also provides uniform blending of carbon dioxide and nitrogen with the aqueous phase and forms a composite fracturing fluid with desirable proppant-carrying properties.

The aqueous base fluid phase may contain various chemical additives routinely used by those skilled in the art, including gelled hydrocarbons, and may be pumped separate for mixing downhole. For example, polymers, cross-linking agents, catalysts, and surfactants, and the aqueous phase may also contain one or more biocides, surface tension reducing non-emulsifying surfactants, clay control agents, salts, fluid loss additives, buffers, gel breakers, iron control agents, paraffin inhibitors and alcohols. Various of these components may be injected separately via tubing and casing for admixture in the downhole region of the well.

Having described specific embodiments of the present invention, it will be understood that other modifications thereof may now be apparent to those skilled in the art. The invention is thus intended to cover all such modifications of downhole blended fracturing, which are within the scope of the appended claims.

What is claimed:

1. A method of hydraulically fracturing a subterranean formation penetrated by a wellbore, at least a portion of the wellbore including a tubing string having a tubing bore and a casing string, the casing string and tubing string forming a casing annulus, a portion of the well bore not including the tubing string therein forming a casing bore, the method comprising:

injecting carbon dioxide into the wellbore via one of the tubing bore and the casing annulus at a first injection flow rate;

simultaneously injecting nitrogen into the wellbore via the other of the tubing string and casing annulus at a second injection flow rate;

simultaneously injecting an aqueous fracturing fluid into the wellbore with at least one of the carbon dioxide and nitrogen, at a third injection flow rate;

combining the carbon dioxide, the nitrogen and the aqueous fracturing fluid in the casing bore to form a downhole mixed composite fracturing fluid having a mixed fluid composition;

injecting the downhole mixed composite fracturing fluid from the casing bore into the subterranean formation at a hydraulic pressure sufficient to hydraulically fracture the formation; and selectively varying one or more of the first injection flow rate, the second injection flow rate, and the third injection flow rate to modify in real time the mixed fluid composition of the downhole mixed composite fracturing fluid, forming a modified downhole mixed composite fracturing fluid.

2. The method as defined in claim 1, further comprising:

adding a solid material proppant to the aqueous fracturing fluid to form a proppant laden downhole mixed composite fracturing fluid having another mixed fluid composition; and thereafter injecting the proppant laden downhole mixed composite fracturing fluid from the casing bore into the subterranean formation at hydraulic pressures sufficient to hydraulically fracture the formation.

3. The method as defined in claim 2, further comprising:

selectively varying one or more of the first injection flow rate, the second injection flow rate, and the third injection flow rate to modify in real time the another mixed fluid composition of the proppant laden downhole mixed composite fracturing fluid.

4. The method as defined in claim 2, wherein a quantity of proppant in the proppant laden downhole mixed composite fracturing fluid is selectively adjusted in real time by varying at least one of the first injection flow rate, the second injection flow rate, and the third injection flow rate.

5. The method as defined in claim 2, further comprising:

monitoring in real time within the well bore a location in the formation of at least one radioactive tracer provided in at least a portion of one or more of the downhole mixed composite fracturing fluid and the proppant laden downhole mixed composite fracturing fluid by monitoring radioactive emissions from the at least one radioactive tracer; and varying at least one of the first injection flow rate, the second injection flow rate, and the third injection flow rate in response to the monitored radioactive emissions.

6. The method as defined in claim 1, further comprising:

while selectively varying one or more of the first injection flow rate, the second injection flow rate and the third injection flow rate, increasing a viscosity of the modified downhole mixed composite fracturing fluid as compared to the downhole mixed composite fracturing fluid and cause viscous inter-fingering of the modified downhole mixed composite fracturing fluid within the downhole mixed composite fracturing fluid within the subterranean formation.

7. The method as defined in claim 1, further comprising:

adding to the aqueous fracturing fluid a selected amount of one or more additives from a group comprising chemical additives, gelling agents, alcohols, salts, fluid loss additives, and encapsulated additives; and selectively varying the selected amount of the one or more of additives added to the aqueous fracturing fluid in response to selectively varying one or more of the first injection flow rate, the second injection flow rate and the third injection flow rate.

8. The method as defined in claim 1, further comprising:

adding a cross-linkable gelling agent to at least one of the carbon dioxide, the nitrogen and the aqueous fracturing fluid; and adding a cross-linking agent to another of the carbon dioxide, the nitrogen, and the aqueous fracturing fluid such that the cross-linkable gelling agent and the cross-linking agent mix downhole in the casing bore in the composite fracturing fluid and cross-link at least a portion of the cross-linkable gelling agent.

9. A method of hydraulically fracturing a subterranean formation penetrated by a wellbore, at least a portion of the wellbore including a tubing string having a tubing bore and a casing string, the casing string and tubing string forming a casing annulus, a portion of the well bore not including the tubing string therein forming a casing bore, the method comprising:

injecting an aqueous fracturing fluid down one of the casing annulus and the tubing bore at a first injection flow rate;

simultaneously injecting an energized fluid down the other of the casing annulus and the tubing bore at a second injection flow rate;

combining the energized fluid and the aqueous fracturing fluid in the casing bore to form a first downhole mixed composite fracturing fluid having a first mixed fluid composition;

injecting the first downhole mixed composite fracturing fluid from the casing bore into the subterranean formation at a hydraulic pressure adequate to fracture the formation; and selectively varying one or more of the first injection flow rate and the second injection flow rate to modify in real time the first mixed fluid composition of the first downhole mixed composite fracturing fluid to form a second downhole mixed composite fracturing fluid.

10. The method as defined in claim 9, further comprising:

adding a solid material proppant to the aqueous fracturing fluid to form a proppant laden downhole mixed composite fracturing fluid having a second mixed fluid composition; and thereafter injecting the proppant laden downhole mixed composite fracturing fluid from the casing bore into the subterranean formation at hydraulic pressures sufficient to hydraulically fracture the formation.

11. The method as defined in claim 10, wherein a quantity of proppant in the composite fracturing fluid is adjusted in real-time by varying at least one of the first injection flow rate and the second injection flow rate.

12. The method as defined in claim 10, further comprising:

selectively varying one or more of the first injection flow rate and the second injection flow rate to modify in real time the second mixed fluid composition.

13. The method as defined in claim 10, further comprising:

monitoring in real time within the well bore a location in the formation of at least one radioactive tracer provided in at least a portion of one or more of the downhole mixed composite fracturing fluid and the proppant laden downhole mixed composite fracturing fluid by monitoring radioactive emissions from the at least one radioactive tracer; and varying at least one of the first injection flow rate and the second injection flow rate in response to the monitored radioactive emissions.

14. The method as defined in claim 9, wherein the energized fluid further comprises:

at least one of carbon dioxide and nitrogen.

15. The method as defined in claim 9, further comprising:

while selectively varying one or more of the first injection flow rate and the second injection flow rate, increasing a viscosity of the second downhole mixed composite fracturing fluid as compared to the first downhole mixed composite fracturing fluid and cause viscous inter-fingering of the second downhole mixed composite fracturing fluid within the first downhole mixed composite fracturing fluid, within the subterranean formation.

16. The method as defined in claim 9, further comprising:

adding a gelling agent to one of the aqueous fracturing fluid and the energized fluid; and adding a cross-linking agent to the other of the aqueous fracturing fluid and the energized fluid, such that the gelling agent and the cross-linking agent mix downhole in the casing bore.

17. A method of hydraulically fracturing a subterranean formation penetrated by a wellbore, at least a portion of the wellbore including a tubing string having a tubing bore and a casing string, the casing string and tubing string forming a casing annulus, a portion of the well bore not including the tubing string therein forming a casing bore, the method comprising:

injecting a first aqueous fracturing fluid including a cross-linkable gelling agent down one of the casing annulus and tubing at a first injection rate;

injecting a second aqueous fracturing fluid including a gel cross-linking agent down the other of the casing annulus and the tubing at a second injection rate;

combining the first aqueous fracturing fluid and the second aqueous fracturing fluid in the casing bore to form a downhole mixed composite fracturing fluid having a first mixed fluid composition;

injecting the downhole mixed composite fracturing fluid from the casing bore into the subterranean formation at pressures sufficient to hydraulically fracture the formation; and selectively varying one or more of the first injection flow rate and the second injection flow rate to modify in real time the first mixed fluid composition of the downhole mixed composite fracturing fluid.

18. The method as defined in claim 17, further comprising:

adding a solid material proppant to one or more of the first aqueous fracturing fluid and the second aqueous fracturing fluid to form a proppant laden downhole mixed composite fracturing fluid having a second mixed fluid composition; and thereafter injecting the proppant laden downhole mixed composite fracturing fluid from the casing bore into the subterranean formation at pressures sufficient to hydraulically fracture the formation.

19. The method as defined in claim 18, further comprising:

varying at least one of the first injection flow rate and the second injection flow rate to selectively modify in real time at least one of a physical property and a chemical property of at least one of the first mixed fluid composition and the second mixed fluid composition.

20. The method as defined in claim 19, wherein selectively adjusting in real time at least one of a physical property and a chemical property further comprises:

selectively varying a viscosity physical property to cause viscous inter-fingering of fluids in the subterranean formation.

21. The method as defined in claim 18, wherein a quantity of proppant in the proppant laden downhole mixed composite fracturing fluid is selectively adjusted in real time by varying at least one of the first injection flow rate and the second injection flow rate.

22. The method as defined in claim 17, further comprising:

monitoring in real time within the well bore a location in the formation of at least one radioactive tracer provided in at least a portion of one or more of the downhole mixed composite fracturing fluid and the proppant laden downhole mixed composite fracturing fluid by monitoring radioactive emissions from the at least one radioactive tracer; and varying at least one of the first injection flow rate and the second injection flow rate in response to the monitored radioactive emissions.

23. The method as defined in claim 17, further comprising:

injecting an energizing fluid comprising one or more of carbon dioxide and nitrogen with one or more of the first aqueous fracturing fluid and the second aqueous fracturing fluid.

* * * * *